US010950176B2

(12) United States Patent
Zhang et al.

(10) Patent No.: US 10,950,176 B2
(45) Date of Patent: Mar. 16, 2021

(54) PIXEL COMPENSATION CIRCUIT, DRIVING METHOD, ELECTROLUMINESCENT DISPLAY PANEL AND DISPLAY DEVICE

(71) Applicants: Chengdu BOE Optoelectronics Technology Co., Ltd., Chengdu (CN); BOE Technology Group Co., Ltd., Beijing (CN)

(72) Inventors: Taoran Zhang, Beijing (CN); Zailong Mo, Beijing (CN); Da Zhou, Beijing (CN); Ke Dai, Beijing (CN); Yiyang Zhang, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 69 days.

(21) Appl. No.: 16/480,340

(22) PCT Filed: Jan. 2, 2019

(86) PCT No.: PCT/CN2019/070056
§ 371 (c)(1),
(2) Date: Jul. 24, 2019

(87) PCT Pub. No.: WO2019/174372
PCT Pub. Date: Sep. 19, 2019

(65) Prior Publication Data

US 2021/0027706 A1 Jan. 28, 2021

(30) Foreign Application Priority Data

Mar. 16, 2018 (CN) ..... 201810219431.5

(51) Int. Cl.
*G09G 3/3291* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 3/3291* (2013.01)

(58) Field of Classification Search
CPC .. G09G 3/3233; G09G 3/3258; G09G 3/3266; G09G 3/12
(Continued)

(56) References Cited

U.S. PATENT DOCUMENTS

2014/0152191 A1* 6/2014 Yang ..... G09G 3/3233 315/240
2015/0235595 A1 8/2015 Sugihara et al.
(Continued)

FOREIGN PATENT DOCUMENTS

CN 102789761 A 11/2012
CN 103021331 A 4/2013
(Continued)

OTHER PUBLICATIONS

Office Action for corresponding Chinese Application 201810219431.5 dated Apr. 26, 2020.

*Primary Examiner* — Calvin C Ma
(74) *Attorney, Agent, or Firm* — Arent Fox LLP; Michael Fainberg

(57) ABSTRACT

The present disclosure discloses a pixel compensation circuit, a driving method, an electroluminescent display panel and a display device. Due to the interaction of a data writing circuit, a voltage input circuit, a discharge control circuit, a storage circuit, a conduction control circuit and a driving circuit, the compensation for a threshold voltage of the
(Continued)

driving circuit and IR Drop of a first power signal may be realized by a simple structure and a simple time sequence.

15 Claims, 9 Drawing Sheets

(58) Field of Classification Search
USPC ..... 345/76
See application file for complete search history.

(56) References Cited

U.S. PATENT DOCUMENTS

| | | | | |
|---|---|---|---|---|
| 2017/0039944 | A1* | 2/2017 | Ma | G09G 3/3266 |
| 2017/0061884 | A1 | 3/2017 | Chen et al. | |
| 2017/0069263 | A1 | 3/2017 | Hu | |
| 2018/0233085 | A1 | 8/2018 | Wang | |
| 2018/0374417 | A1 | 12/2018 | Yang et al. | |
| 2019/0096327 | A1 | 3/2019 | Peng et al. | |

FOREIGN PATENT DOCUMENTS

| | | | |
|---|---|---|---|
| CN | 104409047 | A | 3/2015 |
| CN | 106486063 | A | 3/2017 |
| CN | 106548753 | A | 3/2017 |
| CN | 107452331 | A | 12/2017 |
| CN | 107610652 | A | 1/2018 |
| WO | 2013179847 | A1 | 12/2013 |

* cited by examiner

PIXEL COMPENSATION CIRCUIT, DRIVING METHOD, ELECTROLUMINESCENT DISPLAY PANEL AND DISPLAY DEVICE

This present disclosure is a National Stage of International Application No. PCT/CN2019/070056, filed on Jan. 2, 2019, which claims priority to Chinese patent application NO. 201810219431.5, entitled "PIXEL COMPENSATION CIRCUIT, DRIVING METHOD, ELECTROLUMINESCENT DISPLAY PANEL AND DISPLAY DEVICE", filed on Mar. 16, 2018, both of which are incorporated herein by reference in their entireties.

FIELD

The present disclosure relates to the technical field of display and in particular relates to a pixel compensation circuit, a driving method, an electroluminescent display panel and a display device.

BACKGROUND

An organic light emitting diode (OLED) display has the advantages such as low energy consumption, low production cost, self-illumination, wide viewing angle and high response speed and is one of hot spots in the field of current flat-panel display research, wherein the core technical content of the OLED display is to design a pixel circuit for controlling the light emission of an OLED. The OLED is driven by a current, and the light emission of the OLED is required to be controlled by a stable current to ensure the display uniformity of a display panel.

SUMMARY

A pixel compensation circuit provided by some embodiments of the present disclosure includes:

a data writing circuit configured to provide a data signal for a control end of a driving circuit at a reset stage and a threshold compensation stage;

a voltage input circuit configured to provide a first power signal for an input end of the driving circuit at the reset stage and a light emitting stage;

a storage circuit configured to store a voltage of the input end of the driving circuit and a voltage of a connection node;

a discharge control circuit configured to reset the voltage of the connection node and a voltage of a first electrode of a light emitting device at the reset stage and controlling the driving circuit to write a threshold voltage of the driving circuit into the input end of the driving circuit at the threshold compensation stage;

a conduction control circuit configured to conduct the connection node and the control end of the driving circuit at the light emitting stage; and the driving circuit configured to generate a driving current flowing towards the first electrode of the light emitting device in the light emitting stage so as to drive the light emitting device to emit light.

Alternatively, in some embodiments of the present disclosure, a control end of the data writing circuit is configured to input a first scanning signal, an input end of the data writing circuit is configured to input the data signal, and an output end of the data writing circuit is coupled to the control end of the driving circuit; and the data writing circuit is configured to provide the data signal for the control end of the driving circuit under the control of the first scanning signal;

a control end of the voltage input circuit is configured to input a second scanning signal, an input end of the voltage input circuit is configured to input the first power signal, and an output end of the voltage input circuit is coupled to the input end of the driving circuit; and the voltage input circuit is configured to provide the first power signal for the input end of the driving circuit under the control of the second scanning signal;

a first end of the storage circuit is coupled to the input end of the driving circuit, and a second end of the storage circuit is coupled to the connection node;

a control end of the discharge control circuit is configured to receive the first scanning signal, an input end of the discharge control circuit is configured to receive a reset signal, and an output end of the discharge control circuit is respectively coupled to the connection node, the first electrode of the light emitting device and the output end of the driving circuit; and the discharge control circuit is configured to provide the reset signal for the connection node and the first electrode of the light emitting device under the control of the first scanning signal and controlling the driving circuit to write the threshold voltage of the driving circuit into the input end of the driving circuit; and a control end of the conduction control circuit is configured to receive a third scanning signal, an input end of the conduction control circuit is coupled to the connection node, and an output end of the conduction control circuit is coupled to the control end of the driving circuit; and the conduction control circuit is configured to conduct the connection node and the control end of the driving circuit under the control of the third scanning signal.

Alternatively, in some embodiments of the present disclosure, the discharge control circuit includes a first switching transistor and a second switching transistor;

a gate of the first switching transistor is configured to receive the first scanning signal, a first electrode of the first switching transistor is configured to receive the reset signal, and a second end of the first switching transistor is coupled to the connection node; and a gate of the second switching transistor is configured to receive the first scanning signal, a first electrode of the second switching transistor is configured to receive the reset signal, and a second end of the second switching transistor is respectively coupled to the output end of the driving circuit and the first electrode of the light emitting device.

Alternatively, in some embodiments of the present disclosure, a rising edge of the first scanning signal is converted from a low level signal to a high level signal in a linear rising way.

Alternatively, in some embodiments of the present disclosure, a falling edge of the first scanning signal is converted from the high level signal to the low level signal in a linear falling way.

Alternatively, in some embodiments of the present disclosure, the driving circuit includes a driving transistor; and a first electrode of the driving transistor is respectively connected with the voltage input circuit and the storage circuit, a gate of the driving transistor is respectively connected with the conduction control circuit and the data writing circuit, and a second electrode of the driving transistor is connected with the first electrode of the light emitting device.

Alternatively, in some embodiments of the present disclosure, the storage circuit includes a storage capacitor; and a first end of the storage capacitor is coupled to the input end of the driving circuit, and a second end of the storage capacitor is coupled to the connection node.

Alternatively, in some embodiments of the present disclosure, the conduction control circuit includes a third switching transistor; and a gate of the third switching transistor is configured to receive the third scanning signal, a first electrode of the third switching transistor is coupled to the connection node, and a second electrode of the third switching transistor is coupled to the control end of the driving circuit.

Alternatively, in some embodiments of the present disclosure, the third scanning signal and the first scanning signal are same signal.

Alternatively, in some embodiments of the present disclosure, the voltage input circuit includes a fourth switching transistor; and a gate of the fourth switching transistor is configured to receive the second scanning signal, a first electrode of the fourth switching transistor is configured to receive the first power signal, and a second electrode of the fourth switching transistor is coupled to the input end of the driving circuit.

Alternatively, in some embodiments of the present disclosure, the data writing circuit includes a fifth switching transistor; and a gate of the fifth switching transistor is configured to receive the first scanning signal, a first electrode of the fifth switching transistor is configured to receive the data signal, and a second electrode of the fifth switching transistor is coupled to the control end of the driving circuit.

Alternatively, in some embodiments of the present disclosure, the light emitting device includes an electroluminescent diode; and an anode of the electroluminescent diode is used as the first electrode of the light emitting device, and a cathode of the electroluminescent diode is configured to receive a second power signal.

Accordingly, some embodiments of the present disclosure further provides an electroluminescent display panel including the pixel compensation circuit provided by some embodiments of the present disclosure.

Accordingly, some embodiments of the present disclosure further provides a display device including the electroluminescent display panel provided by some embodiments of the present disclosure.

Accordingly, some embodiments of the present disclosure provides a driving method of the pixel compensation circuit, including:

a reset stage: providing the data signal for the control end of the driving circuit by the data writing circuit; providing the first power signal for the input end of the driving circuit by the voltage input circuit; and resetting the voltage of the connection node and the voltage of the first electrode of the light emitting device by the discharge control circuit;

a threshold compensation stage: providing the data signal for the control end of the driving circuit by the data writing circuit; controlling the driving circuit to write the threshold voltage of the driving circuit into the input end of the driving circuit by the discharge control circuit; and storing the voltage of the input end of the driving circuit and the voltage of the connection node by the storage circuit; and a light emitting stage: providing the first power signal for the input end of the driving circuit by the voltage input circuit; storing the voltage of the input end of the driving circuit and the voltage of the connection node by the storage circuit; conducting the connection node and the control end of the driving circuit by the conduction control circuit; and generating the driving current flowing towards the first electrode of the light emitting device by the driving circuit so as to drive the light emitting device to emit light.

DETAILED DESCRIPTION OF THE EMBODIMENTS

At present, in order to overcome the phenomenon of brightness non-uniformity caused by a threshold voltage $V_{th}$ of a driving circuit and IR Drop, a pixel compensation circuit capable of compensating the threshold voltage $V_{th}$ and IR Drop is generally adopted to drive an OLED to emit light in an OLED display. However, the pixel compensation circuit of the relevant OLED display includes more switching transistors and is relatively complex in time sequence when working to result in relatively high process difficulty, production cost increment and relatively large area occupation. In addition, the charging time of the current pixel compensation circuit is relatively long, and therefore, the high resolution of the OLED display cannot be favorably realized.

Based on this, some embodiments of the present disclosure provides the pixel compensation circuit, the compensation for the threshold voltage of the driving circuit and IR Drop of a first power signal may be realized by a simple structure and a simple time sequence, so that a preparation process may be simplified, the production cost and occupation area may be reduced, and an OLED display panel with high resolution may be favorably designed.

In order to make the purpose, technical scheme and advantages of the present disclosure clearer, the detailed descriptions of the pixel compensation circuit, a driving method, an electroluminescent display panel and a display device are shown in detail below in combination with accompanying drawings. It should be understood that preferred embodiments described below are only intended to illustrate and explain the present disclosure, but are not to limit the present disclosure. In addition, embodiments in this application and characteristics in some embodiments may be intercombined under the condition that no conflicts exist.

Figure 1:
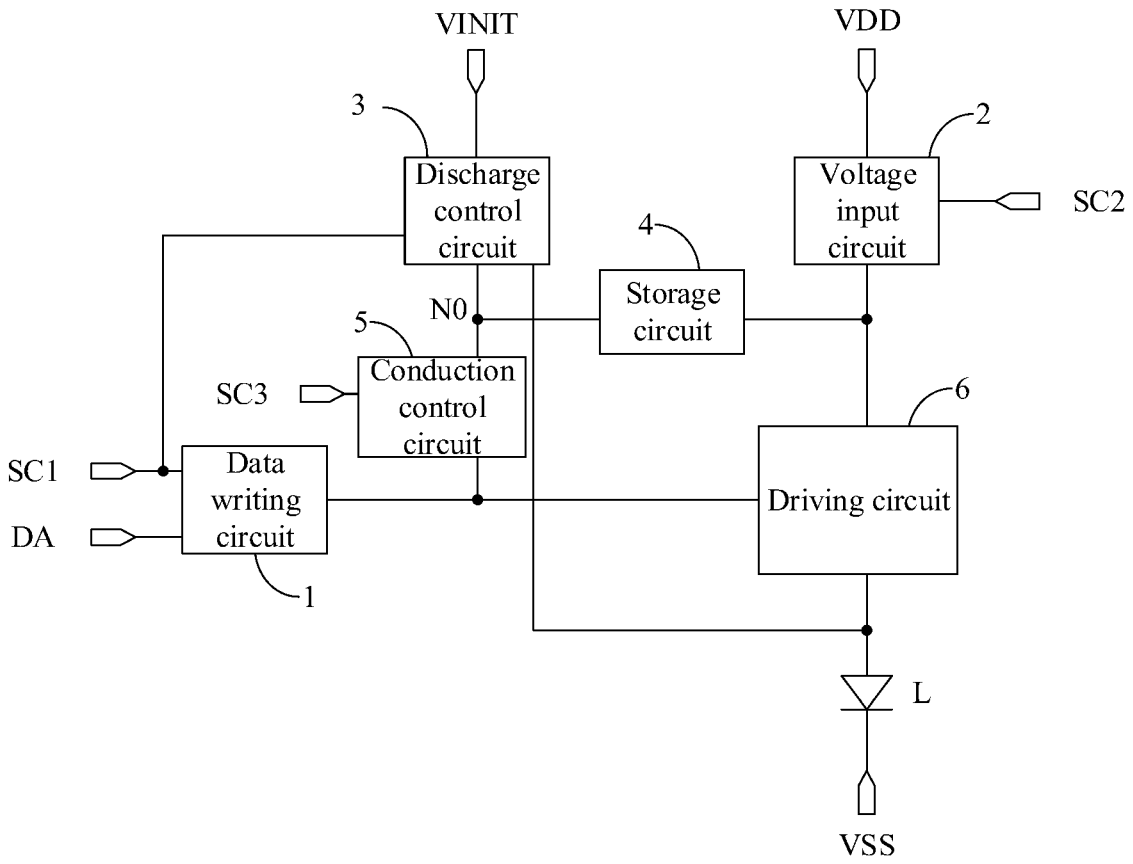
FIG. 1 is a structural schematic diagram of a pixel compensation circuit provided by some embodiments of the present disclosure.

A pixel compensation circuit provided by some embodiments of the present disclosure, as shown in FIG. 1, includes a data writing circuit 1, a voltage input circuit 2, a discharge control circuit 3, a storage circuit 4, a conduction control circuit 5, a driving circuit 6 and a light emitting device L, wherein the data writing circuit 1 is configured to provide a data signal DA for a control end of the driving circuit 6 at a reset stage and a threshold compensation stage;

the voltage input circuit 2 is configured to provide a first power signal VDD for an input end of the driving circuit 6 at the reset stage and a light emitting stage;

the storage circuit 4 is configured to store a voltage of the input end of the driving circuit 6 and a voltage of a connection node N0;

the discharge control circuit 3 is configured to reset the voltage of the connection node N0 and a voltage of a first electrode of the light emitting device L at the reset stage and control the driving circuit 6 to write a threshold voltage of the driving circuit 6 into the input end of the driving circuit 6 at the threshold compensation stage;

the conduction control circuit 5 is configured to conduct the connection node N0 and the control end of the driving circuit 6 at the light emitting stage;

and the driving circuit 6 is configured to generate a driving current flowing towards the first electrode of the light emitting device L in the light emitting stage so as to drive the light emitting device L to emit light.

According to the pixel compensation circuit provided by some embodiments of the present disclosure, at the reset stage, the data signal is provided for the control end of the driving circuit by the data writing circuit, the voltage of the connection node and the voltage of the first electrode of the light emitting device are reset by the discharge control circuit, and the first power signal is provided for the input end of the driving circuit by the voltage input circuit, so that the connection node and the input end of the driving circuit are respectively charged, furthermore, the charging rate is increased, and the charging time is shortened. At the threshold compensation stage, the data signal is provided for the control end of the driving circuit by the data writing circuit, and the driving circuit is controlled and the threshold voltage of the driving circuit is written into the input end of the driving circuit by the discharge control circuit, so that the writing of the data signal and the compensation for the threshold voltage $V_{th}$ of the driving circuit are realized. At the light emitting stage, the first power signal is provided for the input end of the driving circuit by the voltage input circuit, and the connection node and the control end of the driving circuit are conducted by the conduction control circuit, so that the compensation for IR Drop of the first power signal is realized, and the driving circuit is controlled to generate the driving current to drive the light emitting device to emit light. Therefore, due to the interaction of all the circuits, the compensation for the threshold voltage of the driving circuit and IR Drop of the first power signal may be realized by the simple structure and the simple time sequence, so that the preparation process may be simplified, the production cost and occupation area may be reduced, and the OLED display panel with high resolution may be favorably designed.

During specific implementation, in the pixel compensation circuit provided by some embodiments of the present disclosure, as shown in FIG. 1, a control end of the data writing circuit 1 is configured to input a first scanning signal SC1, an input end of the data writing circuit 1 is configured to input the data signal DA, and an output end of the data writing circuit 1 is coupled to the control end of the driving circuit 6; and the data writing circuit 1 is configured to provide the data signal DA for the control end of the driving circuit 6 under the control of the first scanning signal SC1.

A control end of the voltage input circuit 2 is configured to input a second scanning signal SC2, an input end of the voltage input circuit 2 is configured to input the first power signal VDD, and an output end of the voltage input circuit 2 is coupled to the input end of the driving circuit 6; and the voltage input circuit 2 is configured to provide the first power signal VDD for the input end of the driving circuit 6 under the control of the second scanning signal SC2.

A first end of the storage circuit 4 is coupled to the input end of the driving circuit 6, and a second end of the storage circuit 4 is coupled to the connection node N0.

A control end of the discharge control circuit 3 is configured to receive the first scanning signal SC1, an input end of the discharge control circuit 3 is configured to receive a reset signal VINIT, and an output end of the discharge control circuit 3 is respectively coupled to the connection node N0, the first electrode of the light emitting device L and the output end of the driving circuit 6; and the discharge control circuit 3 is configured to provide the reset signal VINIT for the connection node N0 and the first electrode of the light emitting device L under the control of the first scanning signal SC1 and controlling the driving circuit 6 and writing the threshold voltage of the driving circuit 6 into the input end of the driving circuit 6.

A control end of the conduction control circuit 5 is configured to receive a third scanning signal SC3, an input end of the conduction control circuit 5 is coupled to the connection node N0, and an output end of the conduction control circuit 5 is coupled to the control end of the driving circuit 6; and the conduction control circuit 5 is configured to conduct the connection node N0 and the control end of the driving circuit 6 under the control of the third scanning signal SC3.

The present disclosure is described in detail below in combination with specific embodiments. It should be explained that some embodiments aim at better explaining the present disclosure, but not limiting the present disclosure.

Figure 2:
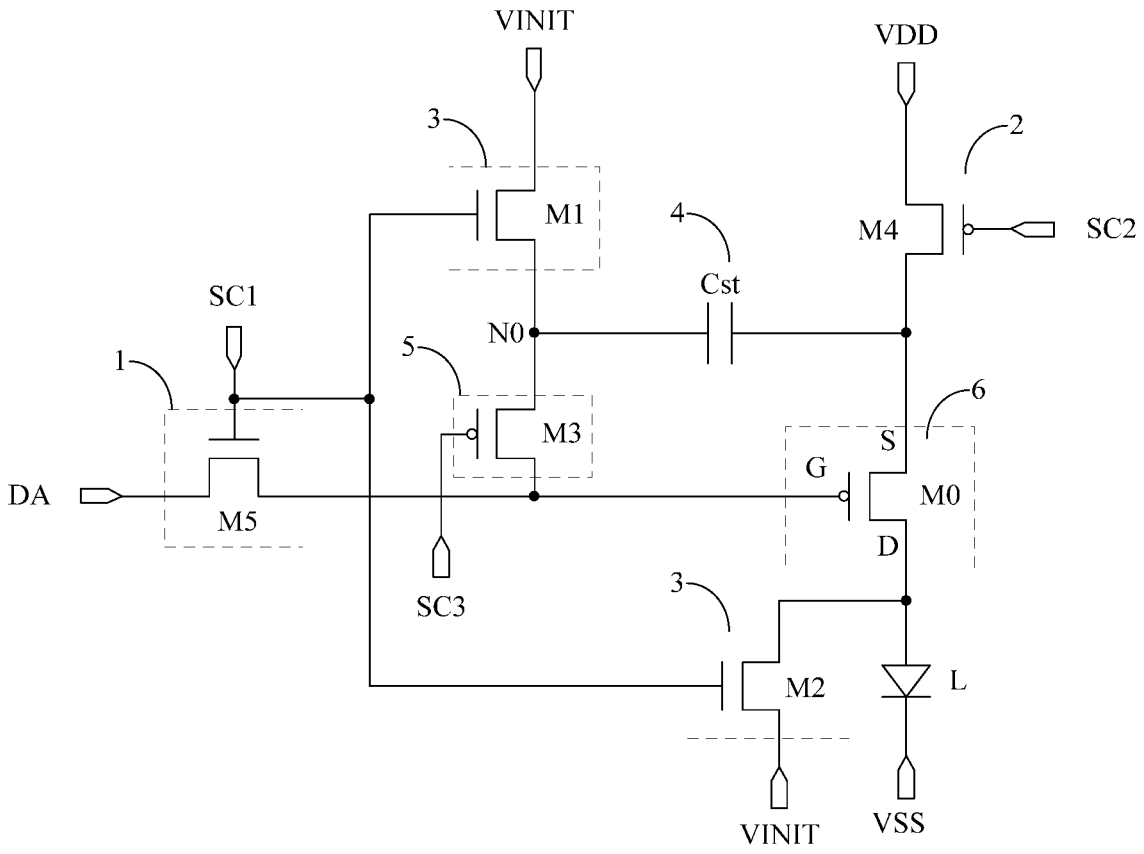
FIG. 2 is a first specific structural schematic diagram of the pixel compensation circuit provided by some embodiments of the present disclosure.

Optionally, in the pixel compensation circuit provided by some embodiments of the present disclosure, as shown in FIG. 2, the driving circuit 6 includes a driving transistor M0, a first electrode S of the driving transistor M0 is respectively connected with the voltage input circuit 2 and the storage circuit 4, a gate G of the driving transistor M0 is respectively connected with the conduction control circuit 5 and the data writing circuit 1, and a second electrode D of the driving transistor M0 is connected with the first electrode of the light emitting device L.

Figure 3:
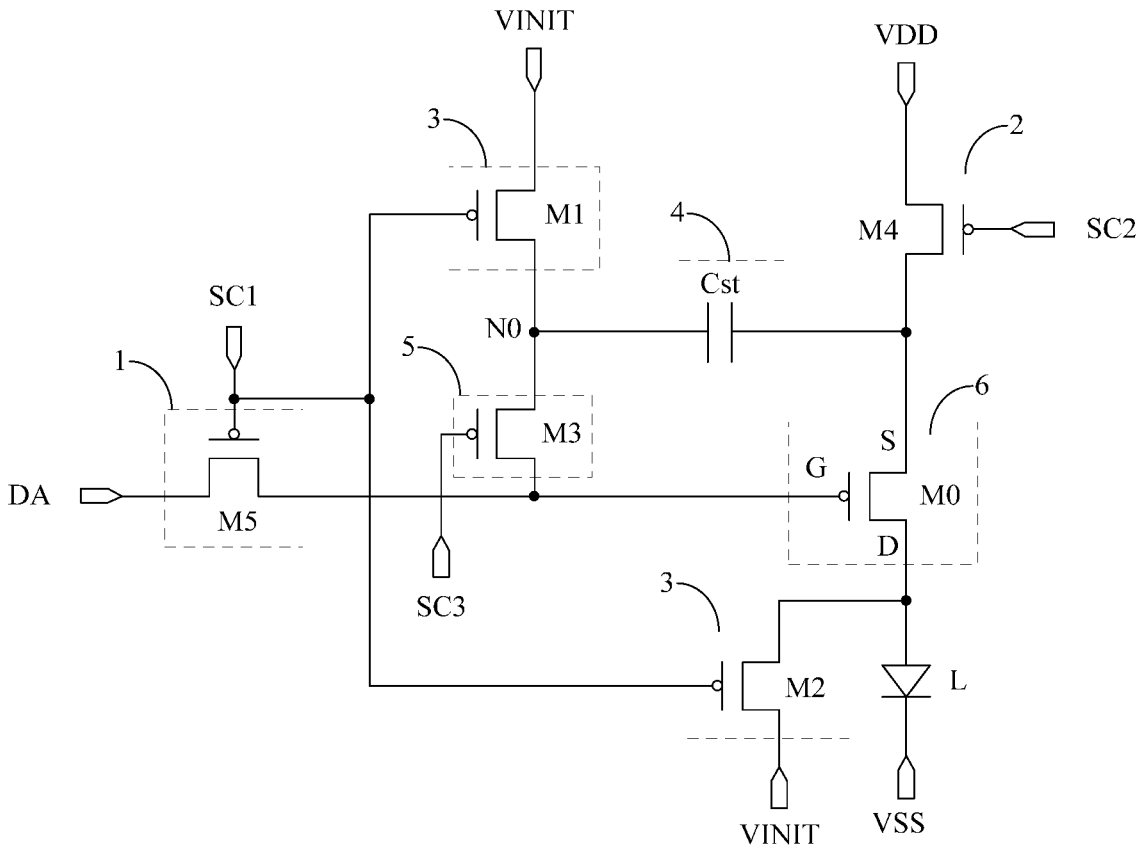
FIG. 3 is a second specific structural schematic diagram of the pixel compensation circuit provided by some embodiments of the present disclosure.
Figure 4:
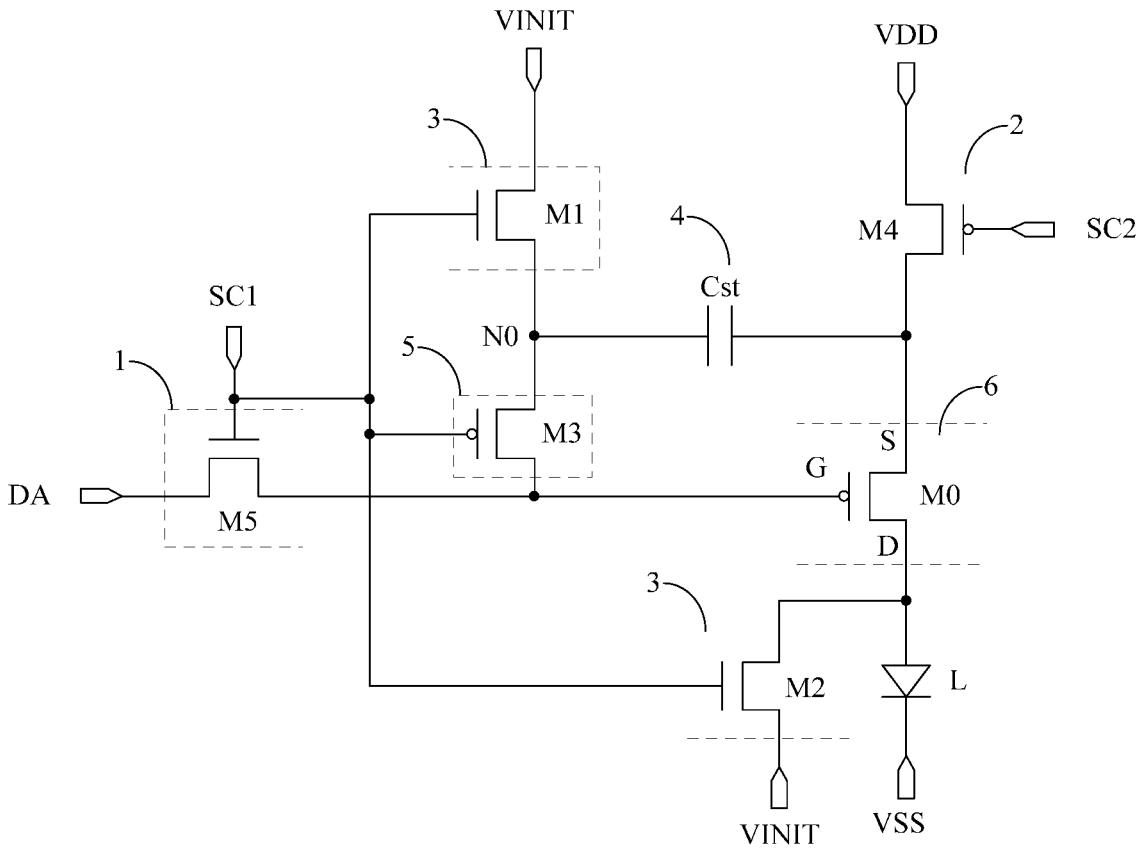
FIG. 4 is a third specific structural schematic diagram of the pixel compensation circuit provided by some embodiments of the present disclosure.

Optionally, during specific implementation, in the pixel compensation circuit provided by some embodiments of the present disclosure, as shown in FIG. 2 to FIG. 4, the driving transistor M0 may be a P-type transistor, wherein the first electrode S of the driving transistor M0 is used as a source electrode of the driving transistor M0, and the second electrode D of the driving transistor M0 is used as a drain electrode of the driving transistor M0. In addition, a current generated when the driving transistor M0 is in a saturated state flows from the source electrode to the drain electrode of the driving transistor M0.

The light emitting device generally emits light under the action of the current generated when the driving transistor is in the saturated state. In addition, an ordinary light emitting device has a light emitting threshold voltage, and the light emitting device emits light when voltages of two ends of the light emitting device are higher than or equal to the light emitting threshold voltage. During specific implementation, in the pixel compensation circuit provided by some embodiments of the present disclosure, the light emitting device may include an electroluminescent diode, wherein an anode of the electroluminescent diode is used as the first electrode of the light emitting device, and a cathode of the electroluminescent diode is configured to receive a second power signal. Optionally, the electroluminescent diode may include an OLED or quantum dot light emitting diodes (QLED).

During specific implementation, in the pixel compensation circuit provided by some embodiments of the present disclosure, the voltage $V_{dd}$ of the first power signal is generally a positive value, and the voltage $V_{init}$ of the reset signal is generally a negative value. The voltage $V_{ss}$, of the second power signal is generally a grounding voltage or a negative value. During an actual application, each of the voltages is required to be designed and determined according to an actual application environment, there is no restriction herein.

Optionally, during specific implementation, in the pixel compensation circuit provided by some embodiments of the present disclosure, as shown in FIG. 2 to FIG. 4, the discharge control circuit 3 may include a first switching transistor M1 and a second switching transistor M2, wherein a gate of the first switching transistor M1 is configured to receive the first scanning signal SC1, a first electrode of the first switching transistor M1 is configured to receive the reset signal VINIT, and a second end of the first switching transistor M1 is coupled to the connection node N0. A gate of the second switching transistor M2 is configured to receive the first scanning signal SC1, a first electrode of the second switching transistor M2 is configured to receive the reset signal VINIT, and a second electrode of the second switching transistor M2 is respectively coupled to the output end of the driving circuit 6 and the first electrode of the light emitting device L.

During specific implementation, in the pixel compensation circuit provided by some embodiments of the present disclosure, the reset signal may be provided for the connection node when the first switching transistor is in a conducting state under the control of the first scanning signal. The reset signal may be provided for the output end of the driving circuit and the first electrode of the light emitting device when the second switching transistor is in a conducting state under the control of the first scanning signal.

During specific implementation, as shown in FIG. 2 and FIG. 4, the first switching transistor M1 and the second switching transistor M2 may be N-type transistors. As shown in FIG. 3, the first switching transistor M1 and the second switching transistor M2 may also be P-type transistors, there is no restriction herein.

Optionally, during specific implementation, in the pixel compensation circuit provided by some embodiments of the present disclosure, as shown in FIG. 2 to FIG. 4, the storage circuit 4 may include a storage capacitor Cst, wherein a first end of the storage capacitor Cst is coupled to the input end of the driving circuit 6, and a second end of the storage capacitor Cst is coupled to the connection node N0.

During specific implementation, the storage capacitor may be charged or discharged according to a signal input to the input end of the driving circuit and a signal input to the connection node so that voltages of two ends of the storage capacitor are stored. The voltage input to the input end of the driving circuit may be coupled to the connection node under a coupling action of the storage capacitor when the connection node is in a floating state.

Optionally, during specific implementation, in the pixel compensation circuit provided by some embodiments of the present disclosure, as shown in FIG. 2 to FIG. 4, the conduction control circuit 5 may include a third switching transistor M3, wherein a gate of the third switching transistor M3 is configured to receive the third scanning signal SC3, a first electrode of the third switching transistor M3 is coupled to the connection node N0, and a second electrode of the third switching transistor M3 is coupled to the control end of the driving circuit 6.

During specific implementation, in the pixel compensation circuit provided by some embodiments of the present disclosure, the connection node and the control end of the driving circuit may be conducted when the third switching transistor is in a conducting state under the control of the third scanning signal, so that the signal of the connection node is input to the control end of the driving circuit.

During specific implementation, as shown in FIG. 2 to FIG. 4, the third switching transistor M3 may be a P-type transistor, of course, the third switching transistor M3 may also be an N-type transistor, there is no restriction herein.

In order reduce the arrangement of signal lines, reduce the amount of signal ports and save the wiring space, the third scanning signal and the first scanning signal may be set to be the same signal during specific implementation. Optionally, as shown in FIG. 4, the gates of all the first switching transistor M1, the second switching transistor M2 and the third switching transistor M3 are configured to receive the first scanning signal SC1. In addition, the types of the first switching transistor M1 and the third switching transistor M3 are different. For example, the first switching transistor M1 is an N-type transistor, and the third switching transistor M3 is a P-type transistor.

Optionally, during specific implementation, in the pixel compensation circuit provided by some embodiments of the present disclosure, as shown in FIG. 2 to FIG. 4, the voltage input circuit 2 may include a fourth switching transistor M4, wherein a gate of the fourth switching transistor M4 is configured to receive the second scanning signal SC2, a first electrode of the fourth switching transistor M4 is configured to receive the first power signal VDD, and a second electrode of the fourth switching transistor M4 is coupled to the input end of the driving circuit 6.

During specific implementation, in the pixel compensation circuit provided by some embodiments of the present disclosure, the first power signal may be provided for the input end of the driving circuit when the fourth switching transistor is in a conducting state under the control of the second scanning signal.

During specific implementation, as shown in FIG. 2 to FIG. 4, the fourth switching transistor M4 may be a P-type transistor, of course, the the fourth switching transistor M4 may also be an N-type transistor, there is no restriction herein.

Optionally, during specific implementation, in the pixel compensation circuit provided by some embodiments of the present disclosure, as shown in FIG. 2 to FIG. 4, the data writing circuit 1 may include a fifth switching transistor M5, wherein a gate of the fifth switching transistor M5 is configured to receive the first scanning signal SC1, a first electrode of the fifth switching transistor M5 is configured to receive the data signal DA, and a second electrode of the fifth switching transistor M5 is coupled to the control end of the driving circuit 6.

During specific implementation, in the pixel compensation circuit provided by some embodiments of the present disclosure, the data signal may be provided for the control end of the driving circuit when the fifth switching transistor is in a conducting state under the control of the first scanning signal.

During specific implementation, as shown in FIG. 2 and FIG. 4, the fifth switching transistor M5 may be an N-type transistor, as shown in FIG. 3, the fifth switching transistor M5 may also be a P-type transistor, there is no restriction herein.

A specific structure of each circuit in the pixel compensation circuit provided by some embodiments of the present disclosure is only illustrated above, during specific implementation, and the specific structure of each circuit is not limited to the structure provided by some embodiments of the present disclosure and may also be one of other structures known by the skilled in the art, there is no restriction herein.

Further, in order to simplify the production process flow of the pixel compensation circuit, during specific implementation, as shown in FIG. 3, all the transistors may be P-type transistors when the driving transistor M0 is a P-type transistor in the pixel compensation circuit provided by some embodiments of the present disclosure.

During specific implementation, in the pixel compensation circuit provided by some embodiments of the present disclosure, the P-type transistors are cut off under the action of a high level and are conducted under the action of a low level; and the N-type transistors are conducted under the action of the high level and are cut off under the action of the low level.

It should be explained that the transistors in the pixel compensation circuit provided by some embodiments of the present disclosure may be thin film transistors (TFT) or metal oxide semimconductor (MOS) field-effect transistors, there is no restriction herein. During specific implementation, the first electrodes of the switching transistors may be used as source electrodes of the switching transistors and the second electrodes of the switching transistors may be used as drain electrodes of the switching transistors according to different types of the switching transistors and different voltages of the signals; or else, the first electrodes of switching transistors are used as the drain electrodes of the switching transistors and the second electrodes of the switching transistors are used as the source electrodes of the switching transistors, there is no specific distinction herein.

A working process of the pixel compensation circuit provided by some embodiments of the present disclosure is described in combination with a circuit time sequence diagram. In the description below, 1 represents for the high level, and 0 represents for the low level. It should be explained that 1 and 0 are logic levels and are only intended to better explain the specific working process of some embodiments of the present disclosure, rather than to represent for the voltage applied to the gate of each switching transistor during specific implementation.

Figure 5A:
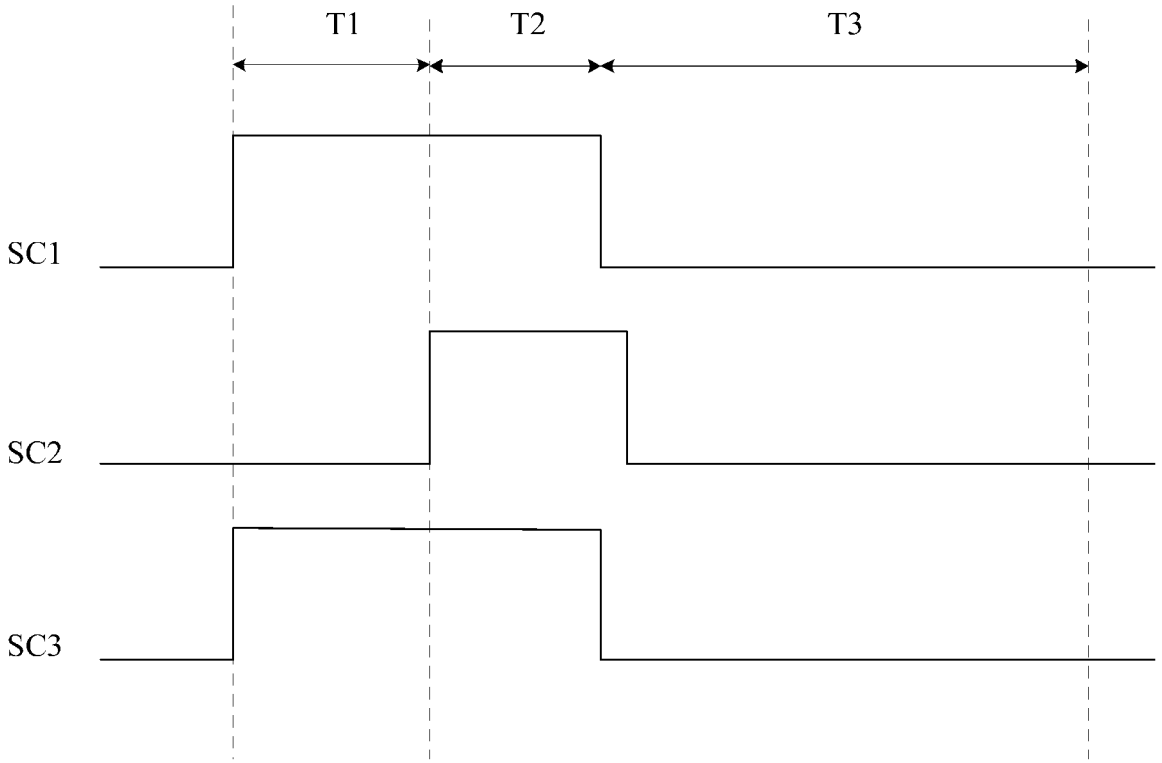
FIG. 5A is a first circuit time sequence diagram provided by some embodiments of the present disclosure.

In some possible embodiments, with the structure of the pixel compensation circuit shown as FIG. 2 as an example, a circuit time sequence diagram corresponding to the pixel compensation circuit is shown as FIG. 5A. In FIG. 5A, a reset stage T1, a threshold compensation stage T2 and a light emitting stage T3 are mainly selected.

At the reset stage T1, SC1 is equal to 1, SC2 is equal to 0, and SC3 is equal to 1.

Because SC1 is equal to 1, all the first switching transistor M1, the second switching transistor M2 and the fifth switching transistor M5 are conducted. The reset signal VINIT is provided for the connection node N0 by the conducted first switching transistor M1, so that the connection node N0 is reset. The reset signal VINIT is provided for the second electrode D of the driving transistor M0 and the anode of the light emitting device L by the conducted second switching transistor M2, so that the anode of the light emitting device L is reset. The data signal DA is provided for the gate G of the driving transistor M0 by the conducted fifth switching transistor M5. Because SC2 is equal to 0, the fourth switching transistor M4 is conducted, and the first power signal VDD is provided for the first electrode S of the driving transistor M0, so that the first electrode S of the driving transistor M0 is reset, and the storage capacitor Cst is charged. At the moment, the voltage $V_G$ of the gate of the driving transistor M0 is the voltage $V_{da}$ of the data signal DA, the voltage Vs of the first electrode S of the driving transistor M0 is the voltage $V_{dd}$ of the first power signal VDD, and the voltage VD of the second electrode D of the driving transistor M0 is the voltage $V_{init}$ of the reset signal VINIT. Therefore, the current flowing from the first electrode S to the second electrode D of the driving transistor M0 may be generated by the driving transistor M0 and released by the second switching transistor M2, so that the phenomenon that the light emitting device L is started in advance due to the current generated by the driving transistor M0 at the stage may be avoided. Because SC3 is equal to 1, the third switching transistor M3 is cut off.

At the threshold compensation stage T2, SC1 is equal to 1, SC2 is equal to 1, and SC3 is equal to 1.

Because SC1 is equal to 1, all the first switching transistor M1, the second switching transistor M2 and the fifth switching transistor M5 are conducted. The reset signal VINIT is provided for the connection node N0 by the conducted first switching transistor M1, so that the voltage $V_{N0}$ of the connection node N0 is $V_{init}$. The reset signal VINIT is provided for the second electrode D of the driving transistor M0 by the conducted second switching transistor M2. The data signal DA is provided for the gate G of the driving transistor M0 by the conducted fifth switching transistor M5, so that $V_G$ is equal to $V_{da}$. Because SC2 is equal to 1, the fourth switching transistor M4 is cut off. Due to the action of the storage capacitor Cst, the the voltage $V_S$ of the first electrode S of the driving transistor M0 may be firstly kept at $V_{dd}$, and then, the current flowing from the first electrode S to the second electrode D of the driving transistor M0 may be generated by the driving transistor M0 and released by the second switching transistor M2, so that the voltage $V_S$ is reduced, namely the storage capacitor Cst is discharged until the voltage $V_S$ of the first electrode of the driving transistor M0 is changed into $V_{da}-V_{th}$, and then, the driving transistor M0 is turned off, so that the compensation for the threshold voltage $V_{th}$ of the driving transistor M0 is realized. In addition, the current generated by the driving transistor M0 at the stage may be released by the second switching transistor M2, so that leak current entering the light emitting device L may be reduced, then, the black screen time is prolonged, and furthermore, the problem of short-time residual images may be relieved. Because SC3 is equal to 1, the third switching transistor M3 is cut off.

At the light emitting stage T3, SC1 is equal to 0, SC2 is equal to 0, and SC3 is equal to 0.

Because SC1 is equal to 0, all the first switching transistor M1, the second switching transistor M2 and the fifth switching transistor M5 are cut off, and the connection node N0 is in the floating state. Because SC2 is equal to 0, the fourth switching transistor M4 is conducted, and the first power signal VDD is provided for the first electrode S of the driving transistor M0, so that the voltage $V_S$ is equal to $V_{dd}$. Because the the connection node N0 is in the floating state, the voltage $V_{N0}$ of the connection node N0 may be jumped as follows: $V_{init}+V_{dd}-V_{da}+V_{th}$ due to the coupling action of the storage capacitor Cst. Because SC3 is equal to 0, the third switching transistor M3 is conducted, so that $V_G$ is equal to $V_{init}+V_{dd}-V_{da}+V_{th}$. According to the characteristic of a current in a saturated state, the driving current IL generated by the driving transistor M0 and configured to drive the light emitting device L to emit light meets a formula: $I_L=K(V_{GS}-V_{th})^2=K[V_{init}+V_{dd}-V_{da}+V_{th}-V_{dd}-V_{th}]^2=K[V_{init}-V_{da}]^2$, wherein $V_{GS}$ is a gate-source voltage of the driving transistor M0; in addition, K is a structural parameter, and $$K=\frac{1}{2}\mu C_o\frac{W}{L},$$

μ represents for the migration rate of the driving transistor M0, $C_o$ represents for the capacitance of a gate oxide layer on a unit area, W/L represents for the width-to-length ratio of the driving transistor M0, and the numerical values in the same structure are relatively stable and may be regarded as constants. Known from the formula, the driving current IL generated by the driving transistor M0 is only related to the voltage $V_{init}$ of the reset signal VINIT and the voltage $V_{th}$ of the data signal DA, but is unrelated to the threshold voltage $V_{th}$ of the driving transistor M0 and the voltage $V_{dd}$ of the first power signal VDD, and influences of drifting of the threshold voltage $V_{th}$ of the driving transistor M0 and IR Drop to the driving current IL may be overcome, so that the driving current of the light emitting device L is kept stable, and furthermore, the normal work of the light emitting device L is guaranteed.

In addition, the voltage $V_{dd}$ is required to be coupled into the connection node N0 under the coupling action of the storage capacitor Cst at the light emitting stage T3, in order to avoid adverse effects to the voltage, stored by the capacitor Cst, of the connection node N0 due to simultaneous conduction of the fourth switching transistor M4 and the first switching transistor M1, during specific implementation, SC1 is equal to 0, SC2 is equal to 1 and SC3 is equal to 0 within a period of time at the beginning of the light emitting stage T3, and thus, the first switching transistor M1 is controlled to be completely turned off when the fourth switching transistor M4 is still in a cut-off state. SC1 is equal to 0, SC2 is equal to 0 and SC3 is equal to 0 after the period of time, so that the fourth switching transistor M4 is controlled to be changed from the cut-off state to the conducting state, and the voltage $V_{dd}$ is coupled into the connection node N0 under the coupling action of the storage capacitor Cst.

In some embodiments provided by the present disclosure, due to the interaction of all the transistors and the storage capacitor, the compensation for the threshold voltage $V_{th}$ of the driving transistor and IR Drop of the first power signal may be realized by the simple structure and the simple time sequence, so that the preparation process may be simplified, and the production cost and occupation area may be reduced. In addition, during specific implementation, the voltage of the first power signal generally has a fixed voltage value, and if the storage capacitor is charged by adopting the first power signal at the reset stage, the charging rate of the storage capacitor may be increased, and the charging time may be shortened, so that the processing rate of the circuit may be increased, and furthermore, it is beneficial to the application to the design of the display panel with high resolution.

Figure 5B:
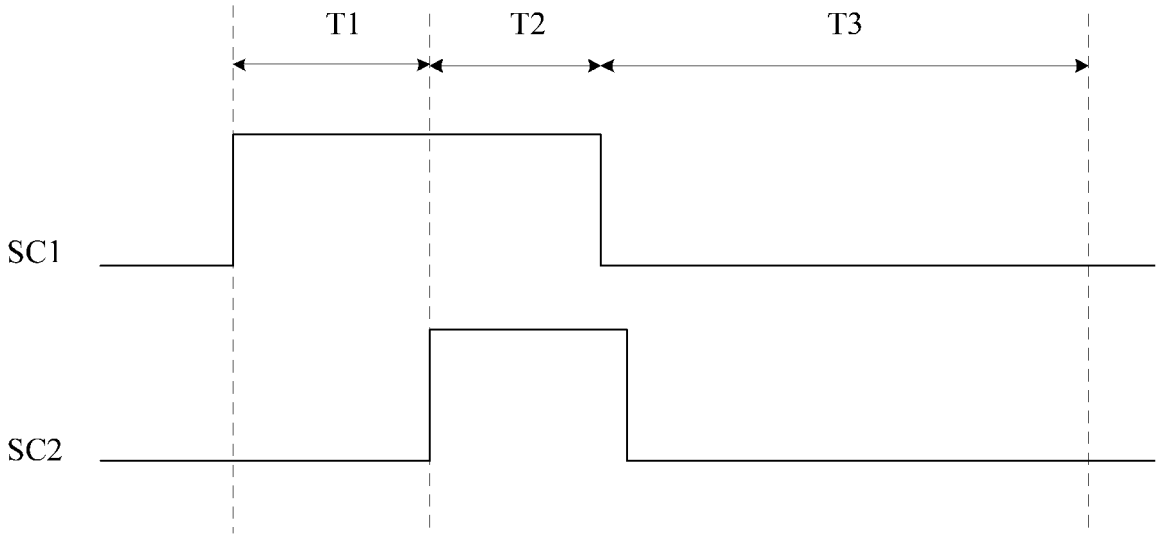
FIG. 5B is a second circuit time sequence diagram provided by some embodiments of the present disclosure.

In some other possible embodiments, with the structure of the pixel compensation circuit shown as FIG. 4 as an example, a circuit time sequence diagram corresponding to the pixel compensation circuit is shown as FIG. 5B. In FIG. 5B, a reset stage T1, a threshold compensation stage T2 and a light emitting stage T3 are mainly selected.

At the reset stage T1, SC1 is equal to 1, and SC2 is equal to 0. Because SC1 is equal to 1, all the first switching transistor M1, the second switching transistor M2 and the fifth switching transistor M5 are conducted, while the third switching transistor M3 is cut off. Because SC2 is equal to 0, the fourth switching transistor M4 is conducted. Therefore, the working process at the stage is basically same as that at the reset stage T1 in aforementioned embodiment, the descriptions thereof are omitted herein.

At the threshold compensation stage T2, SC1 is equal to 1, and SC2 is equal to 1. Because SC1 is equal to 1, all the first switching transistor M1, the second switching transistor M2 and the fifth switching transistor M5 are conducted, while the third switching transistor M3 is cut off. Because SC2 is equal to 1, the fourth switching transistor M4 is cut off. Therefore, the working process at the stage is basically same as that at the threshold compensation stage T2 in aforementioned embodiment, the descriptions thereof are omitted herein.

At the light emitting stage T3, SC1 is equal to 0, and SC2 is equal to 0. Because SC1 is equal to 0, the third switching transistor M3 is conducted, while all the first switching transistor M1, the second switching transistor M2 and the fifth switching transistor M5 are cut off, and the connection node N0 is in the floating state. Because SC2 is equal to 0, the fourth switching transistor M4 is conducted. Therefore, the working process at the stage is basically same as that at the light emitting stage T3 in aforementioned embodiment, the descriptions thereof are omitted herein.

In addition, in order to avoid adverse effects to the voltage, stored by the capacitor Cst, of the connection node N0 due to simultaneous conduction of the fourth switching transistor M4 and the first switching transistor M1, during specific implementation, SC1 is equal to 0 and SC2 is equal to 1 within a period of time at the beginning of the light emitting stage T3, and thus, the first switching transistor M1 is controlled to be completely turned off when the fourth switching transistor M4 is still in a cut-off state. SC1 is equal to 0 and SC2 is equal to 0 after the period of time, so that the fourth switching transistor M4 is controlled to be changed from the cut-off state to the conducting state, and the voltage $V_{dd}$ is coupled into the connection node N0 under the coupling action of the storage capacitor Cst.

In some embodiments provided by the present disclosure, due to the interaction of all the transistors and the storage capacitor, the compensation for the threshold voltage $V_{th}$ of the driving circuit and IR Drop of the first power signal my be realized by the simple structure and the simple time sequence, so that the preparation process may be simplified, and the production cost and occupation area may be reduced. In addition, during specific implementation, the voltage of the first power signal generally has a fixed voltage value, and if the storage capacitor is charged by adopting the first power signal at the reset stage, the charging rate of the storage capacitor may be increased, and the charging time may be shortened, so that the processing rate of the circuit may be increased, and furthermore, it is beneficial to the application to the design of the display panel with high resolution.

Figure 6:
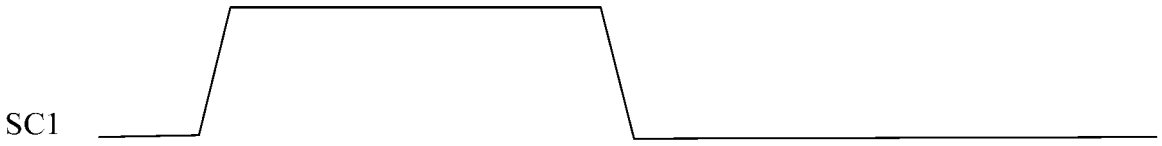
FIG. 6 is a schematic diagram of a waveform of a first scanning signal.
Figure 7A:
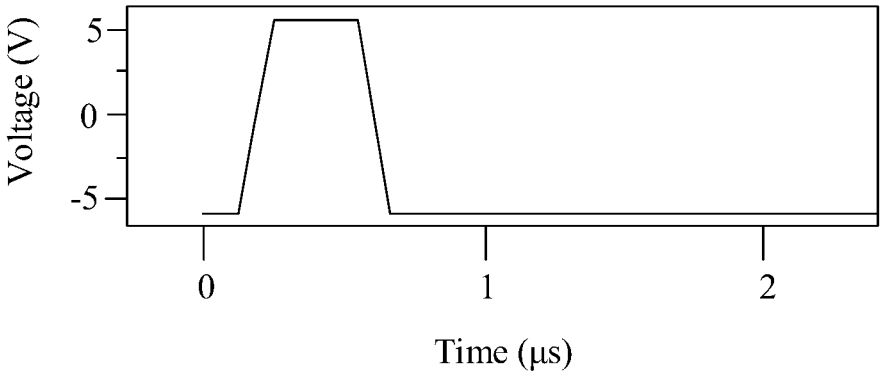
FIG. 7A is a simulated diagram of the first scanning signal.
Figure 7B:
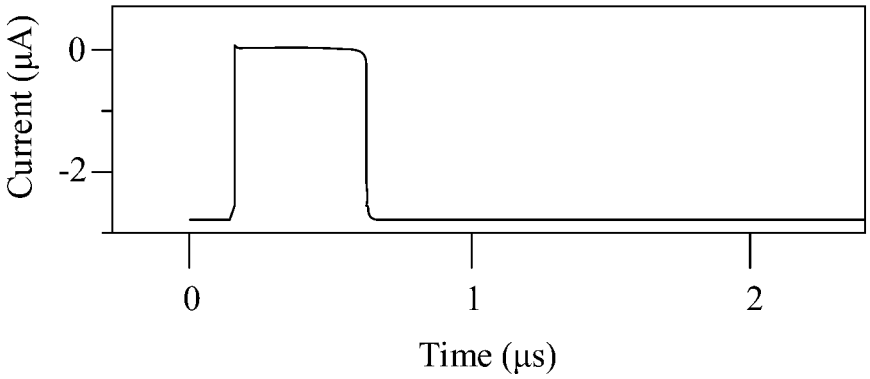
FIG. 7B is a simulated diagram of a current output by an output end of a driving circuit.

During an actual application, when the first scanning signal is switched between the high level and the low level, for example, as shown in FIG. 5A and FIG. 5B, when the first scanning signal SC1 is directly switched from a low level signal to a high level signal or from the high level signal to the low level signal, the driving transistor M0 may generate a peak current with a relatively large current value, so that the circuit may be affected. In order to relieve the influences of the peak current, during specific implementation, as shown in FIG. 6, the rising edge of the first scanning signal SC1 may be gradually converted from the low level signal to the high level signal in a linear rising way. For example, as shown in FIG. 7A and FIG. 7B, FIG. 7A is the simulated diagram of the first scanning signal SC1, wherein a horizontal coordinate represents for time, and a vertical coordinate represents for a voltage value. FIG. 7B is the simulated diagram of the current flowing out of the second electrode D of the driving transistor M0, wherein a horizontal coordinate represents for time, and a vertical coordinate represents for a current value. Seen from FIG. 7A and FIG. 7B, the current flowing out of the second electrode D of the driving transistor M0 may be stable by gradually converting the first scanning signal SC1 from −7V to 7V in a linear rising way, so that the peak current may be avoided.

Of course, as shown in FIG. 6, the falling edge of the first scanning signal SC1 may also be gradually converted from the high level signal to the low level signal in a linear falling way. For example, as shown in FIG. 7A and FIG. 7B, the current flowing out of the second electrode D of the driving transistor M0 may be stable by gradually converting the first scanning signal SC1 from 7V to −7V in a linear falling way, so that the peak current may be avoided.

Based on the same inventive concept, some embodiments of the present disclosure further provide a driving method of the pixel compensation circuit provided by some embodiments of the present disclosure. The problem solving theory of the driving method is similar to that of the pixel compensation circuit, and therefore, the implementation of the driving method may refer to that of the pixel compensation circuit, the descriptions thereof are omitted herein.

Figure 8:
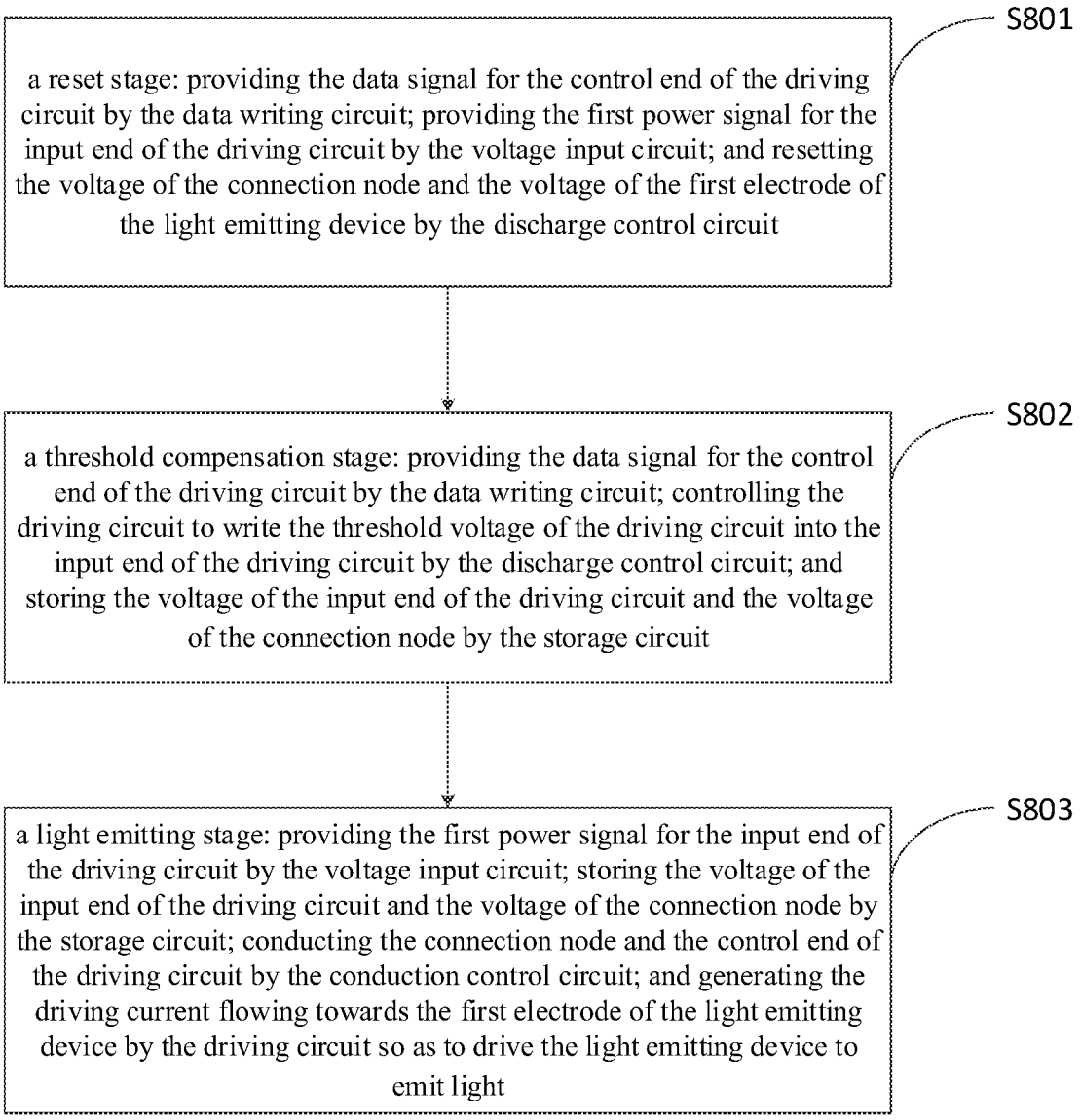
FIG. 8 is a flow diagram of a driving method provided by some embodiments of the present disclosure.
Figure 1:
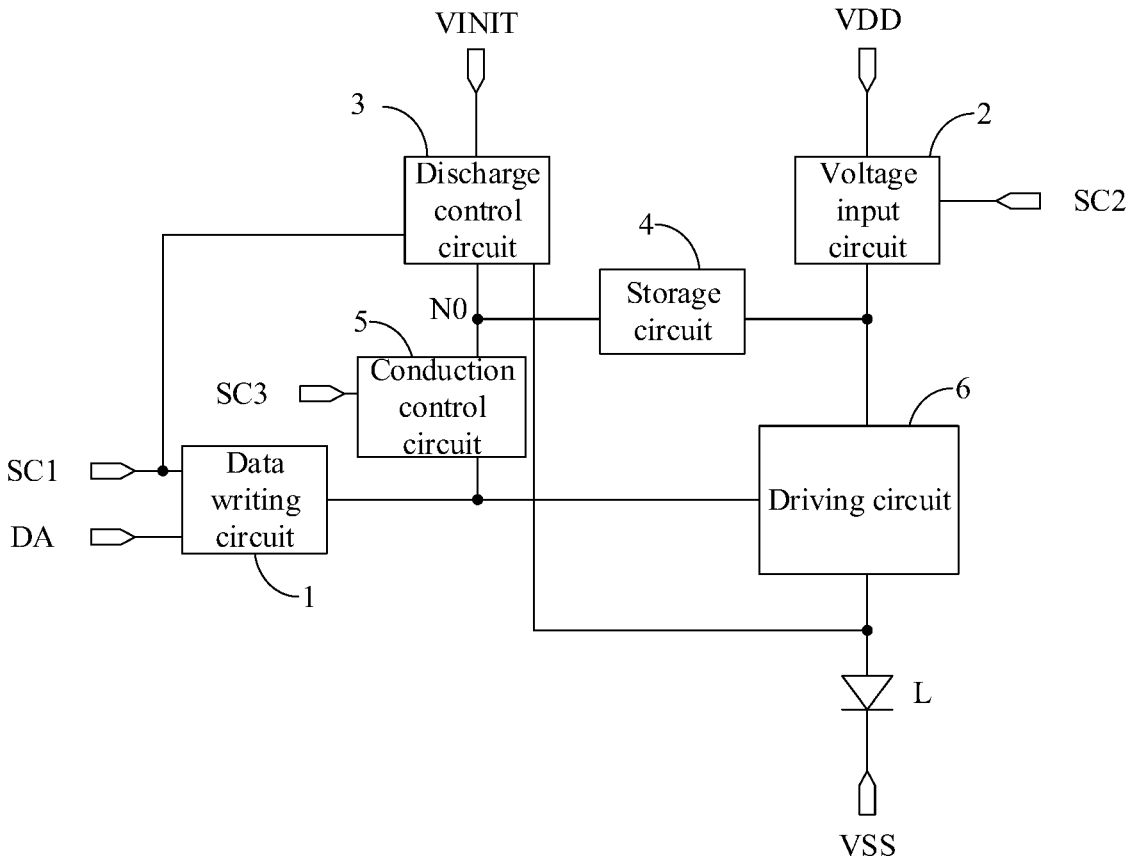

As shown in FIG. 8, the driving method of the pixel compensation circuit provided by some embodiments of the present disclosure may include:

S801, a reset stage: providing the data signal for the control end of the driving circuit by the data writing circuit; providing the first power signal for the input end of the driving circuit by the voltage input circuit; and resetting the voltage of the connection node and the voltage of the first electrode of the light emitting device by the discharge control circuit.

S802, a threshold compensation stage: providing the data signal for the control end of the driving circuit by the data writing circuit; controlling the driving circuit to write the threshold voltage of the driving circuit into the input end of the driving circuit by the discharge control circuit; and storing the voltage of the input end of the driving circuit and the voltage of the connection node by the storage circuit.

S803, a light emitting stage: providing the first power signal for the input end of the driving circuit by the voltage input circuit; storing the voltage of the input end of the driving circuit and the voltage of the connection node by the storage circuit; conducting the connection node and the control end of the driving circuit by the conduction control circuit; and generating the driving current flowing towards the first electrode of the light emitting device by the driving circuit so as to drive the light emitting device to emit light.

According to the driving method provided by some embodiments of the present disclosure, the compensation for the threshold voltage of the driving circuit and IR Drop of the first power signal may be realized by the simple structure and the simple time sequence, so that the preparation process may be simplified, the production cost and occupation area may be reduced, and an OLED display panel with high resolution may be favorably designed.

Based on the same inventive concept, some embodiments of the present disclosure further provide an electroluminescent display panel including the pixel compensation circuit provided by some embodiments of the present disclosure. The problem solving theory of the electroluminescent display panel is similar to that of the pixel compensation circuit, and therefore, the implementation of the electroluminescent display panel may refer to that of the pixel compensation circuit, the descriptions thereof are omitted herein.

During specific implementation, the electroluminescent display panel provided by some embodiments of the present disclosure may include an organic light emitting display panel and a quantum dot light emitting display panel.

Based on the same inventive concept, some embodiments of the present disclosure further provides a display device including the electroluminescent display panel provided by some embodiments of the present disclosure. The implementation of the display device may refer to some embodiments of the pixel compensation circuit, the descriptions thereof are omitted herein.

During specific implementation, the display device provided by some embodiments of the present disclosure may be any one product or component such as a mobile phone, a tablet personal computer, a TV set, a display, a notebook computer, a digital photo frame and a navigator with a display function. Other essential components of the display device should be understood to be provided by the ordinary skilled in the art, the descriptions thereof are omitted herein, and the essential components should not be constructed as limits to the present disclosure.

According to the pixel compensation circuit, the driving method, the electroluminescent display panel and the display device provided by some embodiments of the present disclosure, at the reset stage, the data signal is provided for the control end of the driving circuit by the data writing circuit, the voltage of the connection node and the voltage of the first electrode of the light emitting device are reset by the discharge control circuit, and the first power signal is provided for the input end of the driving circuit by the voltage input circuit, so that the connection node and the input end of the driving circuit are respectively charged, furthermore, the charging rate is increased, and the charging time is shortened. At the threshold compensation stage, the data signal is provided for the control end of the driving circuit by the data writing circuit, and the driving circuit is controlled and the threshold voltage of the driving circuit is written into the input end of the driving circuit by the discharge control circuit, so that the writing of the data signal and the compensation for the threshold voltage $V_{th}$ of the driving circuit are realized. At the light emitting stage, the first power signal is provided for the input end of the driving circuit by the voltage input circuit, and the connection node and the control end of the driving circuit are conducted by the conduction control circuit, so that the compensation for IR Drop of the first power signal is realized, and the driving circuit is controlled to generate the driving current to drive the light emitting device to emit light. Therefore, due to the interaction of all the circuits, the compensation for the threshold voltage of the driving circuit and IR Drop of the first power signal may be realized by the simple structure and the simple time sequence, so that the preparation process may be simplified, the production cost and occupation area may be reduced, and the OLED display panel with high resolution may be favorably designed.

Obviously, various modifications and variations of the present disclosure may be made by the skilled in the art without departing from the spirit and scope of the present disclosure. Thus, if the modifications and variations of the present disclosure belong to the scope of the claims of the present disclosure and equivalent technologies thereof, the present disclosure is also intended to contain the modifications and variations.

The invention claimed is:

1. A pixel compensation circuit, comprising:

a data writing circuit electrically connected with a driving circuit and configured to provide a data signal for a control end of the driving circuit at a reset stage and a threshold compensation stage;

a voltage input circuit electrically connected with the driving circuit and configured to provide a first power signal for an input end of the driving circuit at the reset stage and a light emitting stage;

a storage circuit electrically connected with the driving circuit, a connection node, and configured to store a voltage of the input end of the driving circuit and a voltage of the connection node;

a discharge control circuit electrically connected with the driving circuit, the connection node and a light emitting device, and configured to reset the voltage of the connection node and a voltage of a first electrode of the light emitting device at the reset stage and controlling the driving circuit to write a threshold voltage of the driving circuit into the input end of the driving circuit at the threshold compensation stage;

a conduction control circuit electrically connected with the driving circuit, the connection node, and configured to conduct the connection node and the control end of the driving circuit at the light emitting stage; and the driving circuit electrically connected with the light emitting device and configured to generate a driving current flowing towards the first electrode of the light emitting device in the light emitting stage so as to drive the light emitting device to emit light.

2. The pixel compensation circuit of claim 1, wherein a control end of the data writing circuit is configured to input a first scanning signal, an input end of the data writing circuit is configured to input the data signal, and an output end of the data writing circuit is coupled to the control end of the driving circuit; and the data writing circuit is configured to provide the data signal for the control end of the driving circuit under the control of the first scanning signal;

a control end of the voltage input circuit is configured to input a second scanning signal, an input end of the voltage input circuit is configured to input the first power signal, and an output end of the voltage input circuit is coupled to the input end of the driving circuit; and the voltage input circuit is configured to provide the first power signal for the input end of the driving circuit under the control of the second scanning signal;

a first end of the storage circuit is coupled to the input end of the driving circuit, and a second end of the storage circuit is coupled to the connection node;

a control end of the discharge control circuit is configured to receive the first scanning signal, an input end of the discharge control circuit is configured to receive a reset signal, and an output end of the discharge control circuit is respectively coupled to the connection node, the first electrode of the light emitting device and the output end of the driving circuit; and the discharge control circuit is configured to provide the reset signal for the connection node and the first electrode of the light emitting device under the control of the first scanning signal and controlling the driving circuit to write the threshold voltage of the driving circuit into the input end of the driving circuit; and a control end of the conduction control circuit is configured to receive a third scanning signal, an input end of the conduction control circuit is coupled to the connection node, and an output end of the conduction control circuit is coupled to the control end of the driving circuit; and the conduction control circuit is configured to conduct the connection node and the control end of the driving circuit under the control of the third scanning signal.

3. The pixel compensation circuit of claim 1, wherein the discharge control circuit comprises a first switching transistor and a second switching transistor;

a gate of the first switching transistor is configured to receive the first scanning signal, a first electrode of the first switching transistor is configured to receive the reset signal, and a second end of the first switching transistor is coupled to the connection node; and a gate of the second switching transistor is configured to receive the first scanning signal, a first electrode of the second switching transistor is configured to receive the reset signal, and a second end of the second switching transistor is respectively coupled to the output end of the driving circuit and the first electrode of the light emitting device.

4. The pixel compensation circuit of claim 2, wherein a rising edge of the first scanning signal is converted from a low level signal to a high level signal in a linear rising way.

5. The pixel compensation circuit of claim 2, wherein a falling edge of the first scanning signal is converted from the high level signal to the low level signal in a linear falling way.

6. The pixel compensation circuit of claim 1, wherein the driving circuit comprises a driving transistor; and a first electrode of the driving transistor is respectively connected with the voltage input circuit and the storage circuit, a gate of the driving transistor is respectively connected with the conduction control circuit and the data writing circuit, and a second electrode of the driving transistor is connected with the first electrode of the light emitting device.

7. The pixel compensation circuit of claim 1, wherein the storage circuit comprises a storage capacitor; and a first end of the storage capacitor is coupled to the input end of the driving circuit, and a second end of the storage capacitor is coupled to the connection node.

8. The pixel compensation circuit of claim 1, wherein the conduction control circuit comprises a third switching transistor; and a gate of the third switching transistor is configured to receive the third scanning signal, a first electrode of the third switching transistor is coupled to the connection node, and a second electrode of the third switching transistor is coupled to the control end of the driving circuit.

9. The pixel compensation circuit of claim 8, wherein the third scanning signal and the first scanning signal are same signal.

10. The pixel compensation circuit of claim 1, wherein the voltage input circuit comprises a fourth switching transistor; and a gate of the fourth switching transistor is configured to receive the second scanning signal, a first electrode of the fourth switching transistor is configured to receive the first power signal, and a second electrode of the fourth switching transistor is coupled to the input end of the driving circuit.

11. The pixel compensation circuit of claim 1, wherein the data writing circuit comprises a fifth switching transistor; and a gate of the fifth switching transistor is configured to receive the first scanning signal, a first electrode of the fifth switching transistor is configured to receive the data signal, and a second electrode of the fifth switching transistor is coupled to the control end of the driving circuit.

12. The pixel compensation circuit of claim 1, wherein the light emitting device comprises an electroluminescent diode; and an anode of the electroluminescent diode is used as the first electrode of the light emitting device, and a cathode of the electroluminescent diode is configured to receive a second power signal.

13. An electroluminescent display panel, comprising the pixel compensation circuit of claim 1.

14. A display device, comprising the electroluminescent display panel of claim 13.

15. A driving method of the pixel compensation circuit of claim 1, comprising:

a reset stage: providing the data signal for the control end of the driving circuit by the data writing circuit; providing the first power signal for the input end of the driving circuit by the voltage input circuit; and resetting the voltage of the connection node and the voltage of the first electrode of the light emitting device by the discharge control circuit;

a threshold compensation stage: providing the data signal for the control end of the driving circuit by the data writing circuit; controlling the driving circuit to write the threshold voltage of the driving circuit into the input end of the driving circuit by the discharge control circuit; and storing the voltage of the input end of the driving circuit and the voltage of the connection node by the storage circuit; and a light emitting stage: providing the first power signal for the input end of the driving circuit by the voltage input circuit; storing the voltage of the input end of the driving circuit and the voltage of the connection node by the storage circuit; conducting the connection node and the control end of the driving circuit by the conduction control circuit; and generating the driving current flowing towards the first electrode of the light emitting device by the driving circuit so as to drive the light emitting device to emit light.

* * * * *